United States Patent [19]

Wood

[11] Patent Number: 4,531,343

[45] Date of Patent: Jul. 30, 1985

[54] MACHINE AND PROCESS FOR STACKING AND BUNDLING FLEXIBLE SHEET MATERIAL

[75] Inventor: James R. Wood, Salem, Ill.

[73] Assignee: World Color Press, Inc., Effingham, Ill.

[21] Appl. No.: 311,348

[22] Filed: Oct. 14, 1981

[51] Int. Cl.[3] ..... B65B 13/20

[52] U.S. Cl. ..... 53/399; 53/443; 53/542; 53/586; 271/8.1; 271/151; 271/188; 271/216

[58] Field of Search ..... 53/443, 542, 399, 430, 53/529, 586; 414/103, 104, 109; 271/8 A, 150, 151, 185, 188, 209, 216; 198/423, 462, 425

[56] References Cited

U.S. PATENT DOCUMENTS

| | | | |
|---|---|---|---|
| Re. 21,489 | 6/1940 | Kleinberg | 271/8 A |
| 1,581,583 | 4/1926 | Low | 271/216 X |
| 2,392,746 | 1/1946 | Labombarde | 271/216 X |
| 2,648,431 | 3/1953 | Hartbauer | 53/542 |
| 3,040,488 | 6/1962 | Winkler | 53/443 X |
| 3,155,221 | 11/1964 | Griner | 198/425 |
| 3,236,162 | 2/1966 | Reist | 198/425 |
| 3,317,063 | 5/1967 | Sporte | 414/109 |
| 3,842,719 | 10/1974 | Fernandez-Rana | 271/216 |
| 3,911,800 | 10/1975 | Feldkamper | 198/462 |
| 4,183,517 | 1/1980 | Hageman | 271/150 |
| 4,240,539 | 12/1980 | Klapp | 271/216 |

*Primary Examiner*—John Sipos

*Attorney, Agent, or Firm*—Gravely, Lieder & Woodruff

[57] ABSTRACT

A machine for stacking and bundling flexible sheets, such as the signatures that are delivered from a printed press, includes a succession of aligned conveyors. The sheets are deposited on the first conveyor where they accumulate in a generally horizontal disposition, one on top of the other, and the first conveyor withdraws sheets from the bottom of this pile and conveys them to a gate in a shingled condition. At the gate, which is narrower in width than the sheets, the sheets bow forwardly and rise upwardly at their leading edges until they stand on edge. It is in this condition that the sheets pass onto a second conveyor which moves them through another gate that is narrower than the first gate, so that the degree of bowing increases. The second conveyor moves slower than the first conveyor and as a result the flexible sheets consolidate in the upright condition on the second conveyor. Upon emerging from the second gate, the sheets pass between side conveyors which are closer together than the width of the sheets, and these conveyors also extend along a third conveyor. After a predetermined number of sheets have passed onto the third conveyor, that conveyor speeds up momentarily to produce a gap in the sheets, thereby separating the sheets ahead of the gap into a bundle which is forced onto a final conveyor. Boards are placed at the ends of the bundle, and the bundle is compressed and bound while in the compressed condition.

39 Claims, 14 Drawing Figures

MACHINE AND PROCESS FOR STACKING AND BUNDLING FLEXIBLE SHEET MATERIAL

BACKGROUND OF THE INVENTION

This invention relates in general to the handling of thin sheet material, and more particularly to a machine and process for stacking and bundling such material or otherwise rearranging it.

In the production of magazines and books, the printing industry is to a large measure automated. As such, the industry employs a variety of machines to convert plain paper derived from large rolls into completed magazines and books. Even so, some manual procedures remain in the process, and these procedures are usually quite expensive and introduce the element of human error into the overall printing process.

The modern printing press of the type used in magazine production operates quite rapidly and efficiently, printing usually several pages that are joined together in a single sheet, which is normally folded in the press. This folded sheet is often combined with other folded sheets, but irrespective of whether or not it is folded, the product is referred to as a signature. Each printing press represents an extremely large capital investment, and even though each press is capable of printing several pages at the same time, the typical printing plant usually does not have enough presses to print all the pages of a single magazine or book at once, and even if it did, it would be unwilling to commit all of its presses to a single magazine issue. As a consequence, the delivery from a press is usually stacked manually on a pallet or perhaps hand tied into bundles. Then the press is converted to print different pages of the same magazine issue, which are in turn stacked or bundled. The same procedure occurs with respect to other presses where more pages may be printed. In the end, a relatively large number of stacks or bundles are produced with each stack or bundle containing like signatures and each signature usually being one or more folded sheets consisting of several pages of the magazine.

The stacks or bundles are next delivered to collating and binding machines which extract individual signatures from the stacks or bundles, assemble them in the proper order, and bind them together to form a completed magazine.

Heretofore, the stacking and bundling has been essentially a manual operation that represents a significant factor in the overall cost of a magazine.

SUMMARY OF THE INVENTION

One of the principal objects of the present invention is to provide a machine for automatically stacking thin flexible sheets. Another object is to provide a machine of the type stated that further consolidates the sheets together in tightly packed bundles. A further object is to provide a machine of the type stated which is ideally suited for stacking and bundling signatures delivered from a printing press so that the signatures are in a condition for acceptance by the collating and binding machines that produce a book or magazine, or similar publication. An additional object is to provide a machine of the type stated which takes signatures that are delivered in a generally horizontal disposition, consolidates them, stands them on edge, and then arranges them in bundles. Still another object is to provide a machine of the type stated which further counts the signatures and packages them in bundles with each bundle containing substantially the same number of signatures. These and other objects and advantages will become apparent hereinafter.

The present invention is embodied in a machine that includes conveying means for moving flexible sheets along a path in a generally shingled condition, and gate means along the path for restricting the movement such that the sheets stand on edge with respect to the conveying means. The invention is also embodied in a process including dropping flexible sheets onto a conveyor, picking up the sheets with the conveyor, moving them in a shingled condition, and passing the sheets through a construction where they are converted from a shingled condition to an edge-standing condition. It is further embodied in a process for rearranging sheets from a stacked condition to a shingled condition. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
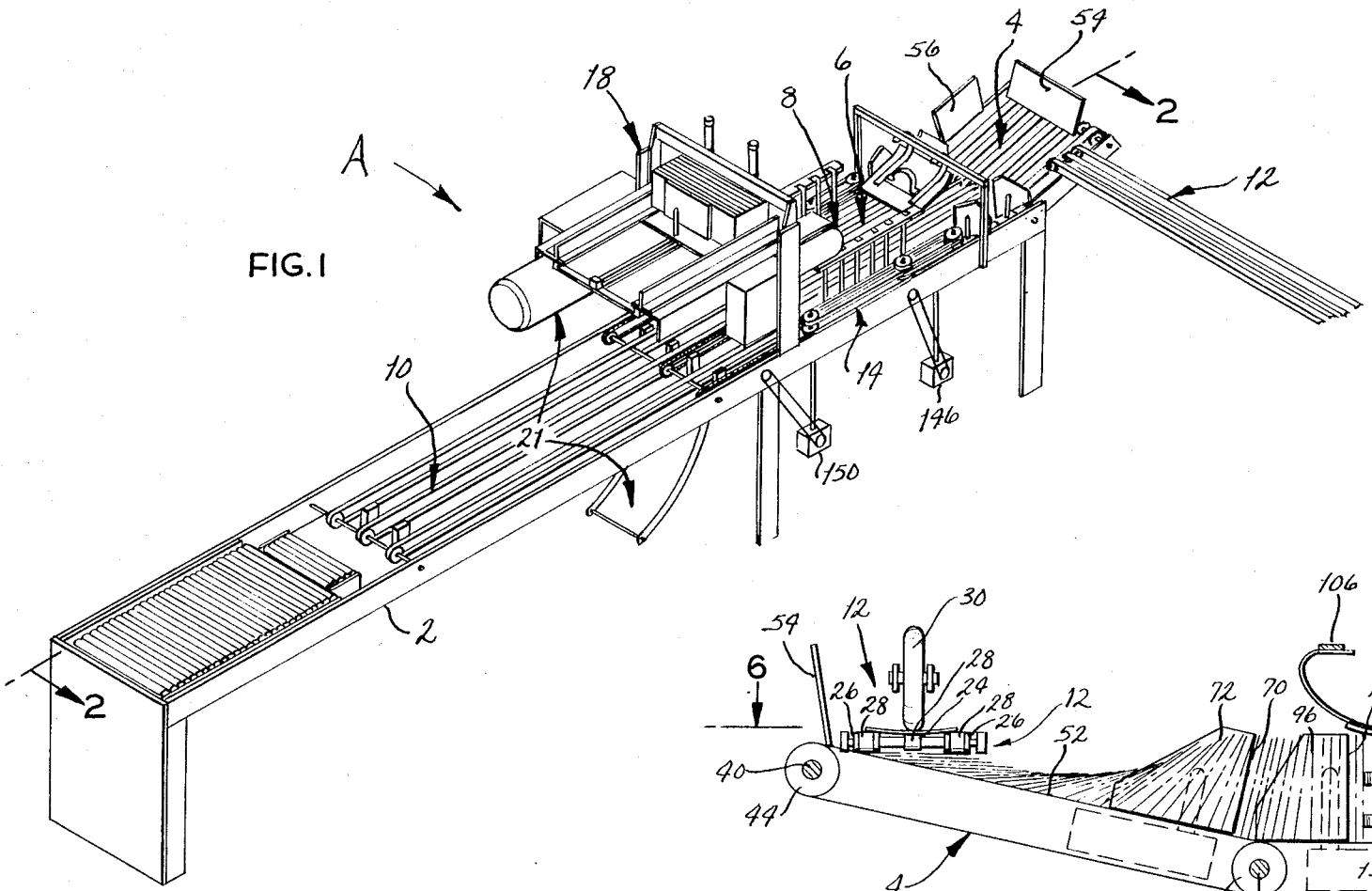
FIG. 1 is a perspective view of a machine constructed in accordance with the present invention for stacking and bundling sheet material such as the signatures derived from a printed press.

Referring now to the drawings, A designates a machine for stacking thin, highly flexible material, such as the signatures s delivered by a printing press, and for thereafter segregating the stacked signatures s into bundles b of generally predetermined number. Each signature s is elongated and may be in a folded condition consisting of two or more leafs, each of which may contain several pages of printed material. The press discharges the signatures s in rapid succession, generally in a longitudinal orientation, that is with the longitudinal axis of each signature s parallel to the path of delivery. Indeed, the printing press may, and normally will discharge the signatures s onto the machine A, which counts the signatures s, stands them on edge, consolidates them into a pack or run in which their margins are neatly registered, isolates a predetermined number of signatures s from the run to form a bundle b, places boards c at the ends of the bundle b, compresses each bundle b, and ties the bundle b of signatures s while it is compressed. The boards c at the ends of the bundles b prevent the ties that hold the bundles b together from damaging the signatures s.

The machine A basically includes a main frame 2 having four aligned conveyors along it—namely (FIGS. 2 and 3), an orienting conveyor 4, a consolidating conveyor 6, an accumulating conveyor 8, and a final conveyor 10, all arranged in that order from one end of the frame 2 to the opposite end. It also includes a feed conveyor 12 (FIGS. 1 and 3) that accepts the signatures s from the press and delivers them to the orienting conveyor 4. The feed conveyor 12 is oriented transversely with respect to the aligned conveyors 4, 6, 8, and 10, and leads up to the orienting conveyor 4 such that it discharges the signatures s onto the orienting conveyor 4 where they accumulate for a short duration. In addition, the machine A has side conveyors 14 (FIGS. 1–3) along the sides of the consolidating and accumulating conveyors 6 and 8. It also has a pusher unit 16 (FIG. 2) beneath the consolidating and accumulating conveyors 6 and 8 for essentially advancing a bundle b onto the final conveyor 10 and coordinating the placement of a board c behind that bundle b. Indeed, at the end of the accumulating conveyor 8 the machine A is provided with a board inserter 18 (FIG. 2) which causes a board c to be at the leading end and trailing end of each bundle b of signatures s. Also along its final conveyor 10, the machine A has a compression unit 20 (FIG. 2) which compresses the bundle b, and also a binding apparatus 21 (FIG. 2) that places binding twine around each bundle b and boards c at the ends of that bundle b while the bundle b is compressed by the compression unit 20.

Considering first the feed conveyor 12 (FIGS. 1 and 3), it extends from the discharge of a printing press to the main frame 2, it being connected to the main frame 2 at the side of the orienting conveyor 4. Here, the feed conveyor 12 is provided with an axle 22 that is fitted with three idler pulleys, namely a center pulley 24 and two side pulleys 26. The center idler pulley 24 is slightly smaller than the two outer pulleys 26 and furthermore is free to rotate independently of the two outer pulleys 26. Extended around the pulleys 22 and 24 are feed belts 28, there being two outer belts 28 and a center belt 28 which together form a surface that is wide enough to support a succession of signatures s which are delivered to the belts 28 by the printing press.

Figure 5:
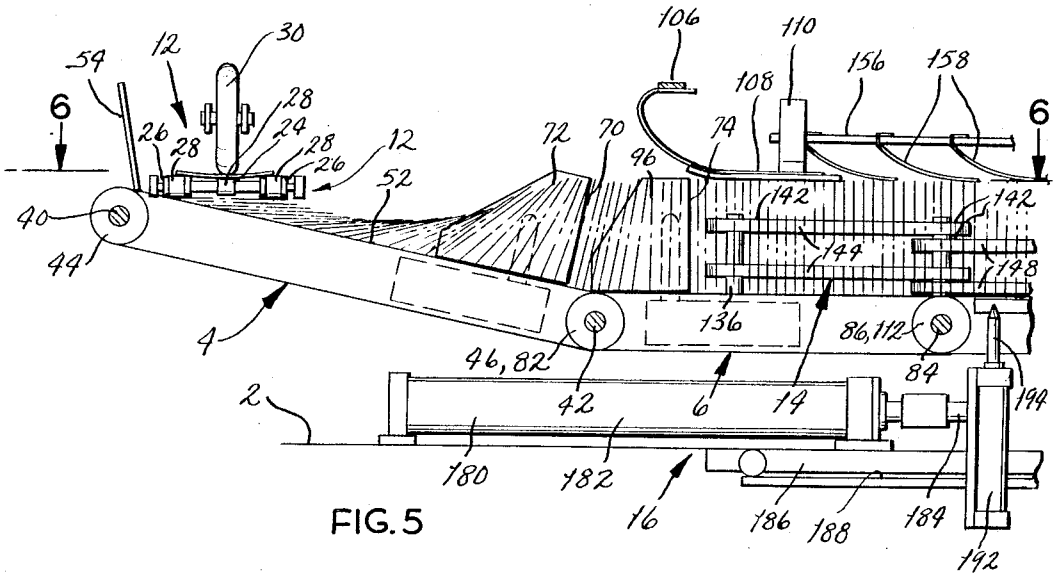
FIG. 5 is a partial side elevational view of the machine showing the signatures as they are converted from a shingled condition to an upstanding stacked condition.

The belts 28 are driven from the opposite end of the conveyor 12 by a variable speed motor (not shown) such that the upper passes of the three belts 28 move toward the orienting conveyor 4. All three belts 28 move at the same velocity and at any point along the conveyor 12 are at generally the same elevation, except at the discharge end. Here, by reason of the reduced diameter of the center idler pulley 24, the center belt 28 is somewhat below the two side belts 32 (FIG. 5).

Moreover, directly above the center idler pulley 24 is a floating pressure wheel 30 (FIG. 5) which will ride on that portion of the center belt 28 that passes over the center pulley 24, unless a signature s is interposed between the two, in which case the pressure wheel 30 by virtue of its own weight will flute the signature s that is beneath it. In other word, the pressure wheel 30 will cause each signature s that passes beneath it to assume a bowed or fluted configuration, and this of course rigidifies the signature s along its longitudinal axis as the signature s is discharged over the orienting conveyor 4. Indeed, enough rigidity is imparted to enable the signature s to project out over the orienting conveyor 4 in somewhat of a cantilevered manner, while only a small portion of it remains confined between the feed belts 28 and the pressure wheel 30. Thus, the elongated signature s is prevented from looping downwardly and perhaps doubling under itself as it passes onto the orienting conveyor 4.

Located immediately beyond the discharge end of the feed conveyor 12 is a light source 32 (FIG. 3) which projects a beam of light over the orienting conveyor 4 and toward the edges of the signatures s. The light source 32 is coupled with a sensor 34 which in turn is connected to a counting device. Each time a signature s passes off of the feed conveyor 12, the light beam is interrupted, and this interruption is observed by the sensor 34 which causes the counter to register the discharge of another signature onto the orienting conveyor 4.

Turning now to the orienting conveyor 4 (FIGS. 2 and 3) at the feed and of the main frame 2, it includes two axle shafts 40 and 42 that are parallel and extend transversely across the frame 2, with the shaft 42 being located ahead of the shaft 40 in terms of the direction of advance for the signatures s along the conveyor 4. Moreover, the first shaft 40 is elevated slightly with respect to the second shaft 42, the elevation being such that a plane defined by the axes of the two shafts 40 and 42 is inclined between about 8° and 12° with respect to the horizontal. Indeed, the inclination of the orienting conveyor 4 is controlled by a linkage arrangement 43 (FIG. 2) that is between the main frame 2 and the conveyor 4. The shaft 40 is fitted with a plurality of timing pulleys 44 which are arranged at equal intervals along it. The shaft 42 is likewise fitted with timing pulleys 46 that are equal in diameter to the pulleys 44 on the shaft 40 and are arranged such that each pulley 46 on the shaft 42 aligns with a different pulley 44 on the shaft 40. Moreover, the pulleys 46 are fitted firmly to the shaft 42 so that they will rotate with the shaft 42. The shaft 42 is in turn connected by means of a sprocket and chain drive 48 to a variable speed gear motor 50 that is mounted on the frame 2. Extended around each pair of corresponding pulleys 44 is a timing belt 52 of the double tooth variety, that is one having teeth or ribs that project inwardly for meshing with the teeth on the pulleys 44 and 46 and more teeth that project outwardly. The latter serve to grip signatures s so as to assist in bringing them into a shingled condition and thereafter turning them upon edge, for the upper passes of the belts 52 are located entirely below the discharge end of the feed conveyor 12 and as such serve as a moving support for the signatures s after they are discharged from the feed conveyor 12. In this regard, the discharge end or the feed conveyor 12 is set backwardly from the outermost belt 52 of the orienting conveyor 4 so as not to obstruct the signatures s from dropping downwardly to the upper passes of the belts 52. Moreover, the spread between the two outer belts 52 is about as great as the width of the individual signatures s, and the spacing between adjacent belts 52 is sufficient to enable the signatures s to rest upon the upper passes of the belts 52 without significant sagging. Also the upper passes of the belts 52 are prevented from sagging by skid plates (not shown) which underlie them. By reason of the elevation of the shaft 40 above the shaft 42, the upper passes of the belts 52 are inclined downwardly toward the consolidating conveyor 6 at an angle of between about 8° and 12°.

In the region generally above the axle shaft 40 for the orienting conveyor 4, the frame 2 is fitted with a guide plate 54 (FIGS. 1, 2, 5, and 6) that is set back slightly from the side edge of the feed conveyor 12 and is oriented in a generally upright disposition, although it is canted slightly such that its lower end is set slightly inwardly from its upper end. The plate 54, which is adjustable as to inclination and also as to position along the conveyor 4, serves to guide any signatures s that may discharge from the feed conveyor 12 in a somewhat skewed condition into a squared orientation with respect to belts 52 of the orienting conveyor 4.

Also along the side of the conveyor 4 directly opposite from the discharge end of the feed conveyor 12 is a stop plate 56 (FIGS. 1, 3, and 6) that is parallel to the belts 52 and is in a truly upright position. The stop plate 56 prevents the signatures s from sliding too far across the belts 52 of the conveyor 4 as they are discharged from the feed conveyor 12 and in that sense brings the side edges of the signatures s into registration. The arrangement is such that fluted signatures s, upon being driven off of the belts 28 of the feed conveyor 12, will slide across signatures s that have already accumulated upon the belts 52 of the orienting conveyor 4 and come to rest against the stop plate 56. Accordingly, the end of a newly deposited signature s will register with signatures s already deposited on the belts 52.

While the belts 52 are inclined downwardly away from the feed conveyor 12, the signatures s upon coming to rest upon the orienting conveyor 4 assume a generally horizontal disposition, this being by reason of the shingling imparted to the signatures s by the moving belts 52 (FIG. 5). In this regard, the signatures s tend to accumulate in a small pile or stack between the stop plate 56 and the end of the feed conveyor 12, and this stack is constantly depleted from beneath by the moving belts 52. In other words, the belts 52 withdraw the signatures s from beneath the stack of signatures s by generally gripping the trailing edges of the signatures s with their outwardly projecting teeth. The withdrawal is such that the belts 52 engage the signatures s successively from beneath the stack, so that upon emerging from the stack the signatures s are in a shingled arrangement along the belts 52, with the angle between the shingled signatures s and the belts 52 being less than about 45°. As a consequence, the leading edge of any signature s is held away from the surfaces of the belts 52 by the signatures s which immediately precedes it, while the trailing edge remains in engagement with the belts 52, usually at teeth along the belts 52. Hence, the signatures s which accumulate on top of the shingled arrangement of signatures immediately in contact with the belts 52 are generally in a horizontal disposition. The top signature s in the stack therefore creates a horizontal slideway across which the next signature s, upon being discharged from the feed conveyor 12 will pass, generally without tending to skew or otherwise become disoriented.

The stop plate 56 is provided with a reflective strip 60 (FIG. 3) onto which a beam of light is projected from a light source 62 located along the opposite side of the conveyor 4, and the point at which the beam reflects off of the strip 60 is at the height which the stack of signatures s is to assume on the belts 52. The reflected beam is monitored by a sensor 62 which in turn controls the speed at which the motor 50 operates. More specifically, when the stack of signatures s at the upstream end of the conveyor 4 prevents the beam from reflecting off of the strip 60, the sensor 62 registers the absence of light and through an appropriate control circuit increases the speed of the motor 50. This causes the belts 52 to move at a higher velocity and remove the signatures s from the bottom of the stack with greater rapidity. The height of the stack will then diminish and eventually the beam will again reflect from the strip 60. The sensor 64 again detects the light and reduces the speed of the motor 50.

Figure 6:
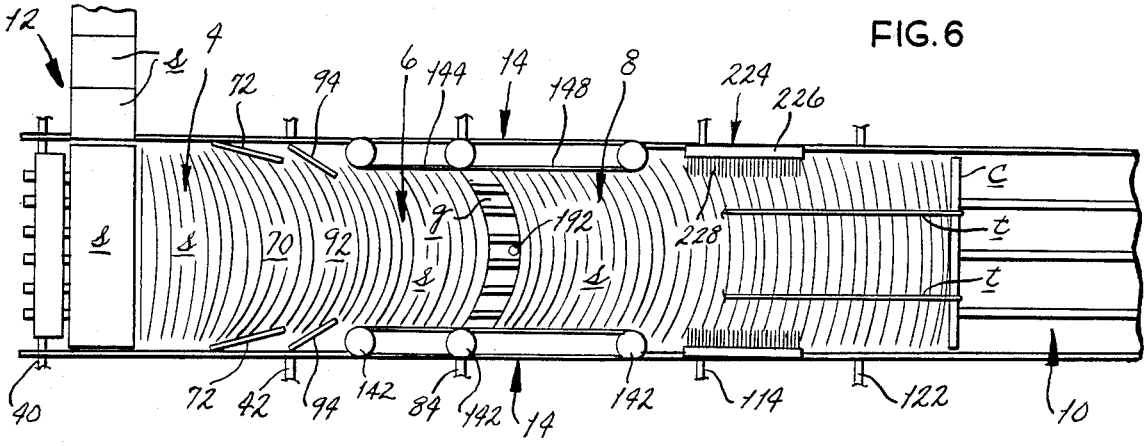
FIG. 6 is a plan view taken along line 6—6 of FIG. 5, likewise showing the machine with the signatures on it; and FIGS. *7a* through *7h* consist of several elevational views of a schematic nature showing the sequence of operation for the machine.
Figure 4:
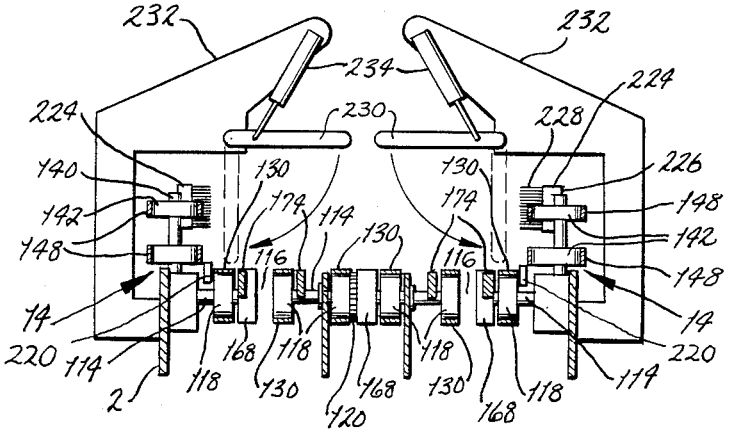
FIG. 4 is a sectional view taken along line 4—4 of FIG. 2 and showing the sweeper arms of the machine.

At the downstream end of the conveyor is a gate 70 that converges to a width less than that of the signatures s. For purposes of this discussion, the width of a signature s is the distance measured from its one end to its other end and transversely with respect to the direction of advance. The gate 70 causes the shingled signatures s that are carried along by the belts 52 to bow forwardly as the signatures s pass through the gate 70 and to further rise at their leading margins (FIGS. 5 and 6). In effect, the signatures s are standing on edge by the time they emerge from the gate 70. Due to the previous shingling, the edge-standing signatures s are spaced slightly apart, but the bowed configuration keeps them upright on the belts 52.

The gate 70 is formed by a pair of deflecting plates 72 (FIGS. 2 and 3), there being one plate 72 along each of the two outer belts 52. Each plate 72 is cocked at a slight angle with respect to the belts 52, but its leading edge is perpendicular to the plane defined by the upper passes of the belts 52. The angles at which the plates 72 are disposed may be adjusted.

Each plate 72 is fastened to a post 74 which in turn is supported on the main frame 2. The arrangement is such that the posts 74 can turn to change the angles of their respective deflecting plates 72 with respect to the direction of advance for the signatures s along the conveyor 4. Also the posts 74 may be adjusted transversely with respect to the conveyor 4 to change the spacing between the two deflecting plates 72. More specifically, the posts 74 are adjusted such that the width of the gate 70 at its leading end, that is at the leading edges of the plates 72 is less than the length of the signatures s (FIG. 5). However, each plate 72 is canted such that the trailing end of the gate 70 is wider than the width of the signatures s.

The belts 52, of course, engage the shingled signatures s along the trailing margins of the signatures s, and as the belts 52 force the signatures s into and through the gate 70, the signatures s tend to rise and stand on edge in the presence of the constriction created by the gate 70. Furthermore, the end edges of the signatures s drag along the deflecting plates 72 and are with respect to their center portions restrained. This restraint, coupled with narrowness of the gate 70 at its leading end, causes the signatures s to arch or bow forwardly. The signatures s emerge from the gate 70 generally in a perpendicular disposition with respect to the upper passes of the belts 52 and in a slightly bowed configuration, although they are spaced somewhat apart owing to the previous shingling. They nevertheless remain upright due to the bowed configuration.

The consolidating conveyor 6 (FIGS. 2 and 3) lies immediately beyond the orienting conveyor 4 and along it the bow or arch of the signatures s is amplified and the signatures s are further urged together so as to somewhat consolidate the array of successive signatures s. The array or run of signatures s accordingly acquires greater stability in standing on edge. The consolidating conveyor 6 includes a plurality of pulleys 82 which share the axle shaft 42 with the pulleys 46 of the orienting conveyor 4. The pulleys 82 are interposed between the pulleys 46 and are of the same diameter, but in contrast to the pulleys 46, the pulleys 82 are free to rotate on the shaft 42. In addition, the consolidating conveyor 6 has another axle shaft 84 that is mounted on the main frame 2 parallel to and at the same elevation as the shaft 42. The shaft 84 has pulleys 86 fitted to it such that the pulleys 86 will rotate with the shaft 84, which is connected to the shaft 42 through a sprocket and chain drive 88. The pulleys 86 are the same diameter as the pulleys 82, and each pulley 86 aligns with a different pulley 82. Extended around corresponding pulleys 82 and 86 are more double tooth timing belts 92. The upper passes of the belts 92 form a horizontal continuation of the upper passes for the preceding belts 52, and are likewise supported on skid plates. The speed ratio of the sprocket and chain drive 88 is such that the belts 92 move at a lesser velocity than the belts 52 of the orienting conveyor 4, that ratio being about 2:3. Since the belts 92 always move at a slower speed than the belts 52, the edge standing signatures s will consolidate along the belts 92.

Located along the consolidating conveyor 6 is another converging gate 94 (FIGS. 3 and 6), the width of which at its leading end is slightly smaller than that of the preceding gate 70. The gate 94 is formed by deflecting plates 96 which are along the outermost belts 92 and have vertical leading and trailing edges, that is, edges that are perpendicular to the plane defined by the upper passes of the belts 92. Moreover, each plate 96 is canted inwardly, so that the space between the leading edges of the two plates 96 is less than the space between the trailing edges. Indeed each plate 96 is fastened to a vertical post 98 which in turn is supported on the main frame 2 such that the posts 98 can be turned to alter the angle of deflection for the plate 96. Also, the spacing between the two plates 96 can be varied.

As the signatures s pass through the second gate 94, their side edges are again restrained by the friction along the deflecting plates 96 and the signatures s bow still further forwardly. This reorients the signatures s so that they come to a truly upright position on the belts 92 after passing off of the inclined belts 52. Also, the reduced speed of the belts 92 causes the signatures s to consolidate or come closer together on belts 92. This provides greater stability for the array or run of signatures s emerging from the second gate 94.

In the region of the second gate 94 is an overhead support 106 (FIGS. 2 and 5) that is attached to the main frame 2, and suspended from the support 106 is a plate 108 that rests on top margins of the signatures s as they pass through the gate 94. The plate 108 has a vibrator unit 110 mounted on it. That portion of the vibrating plate 108 which is presented downstream is turned upwardly so that the upper edges of the signatures s do not snag upon the plate 108, but instead pass beneath it. The weight of the plate 108 coupled with the vibrations imparted to it by the vibrator unit 110 jog the signatures s and bring their horizontal edges into registration.

Figure 3:
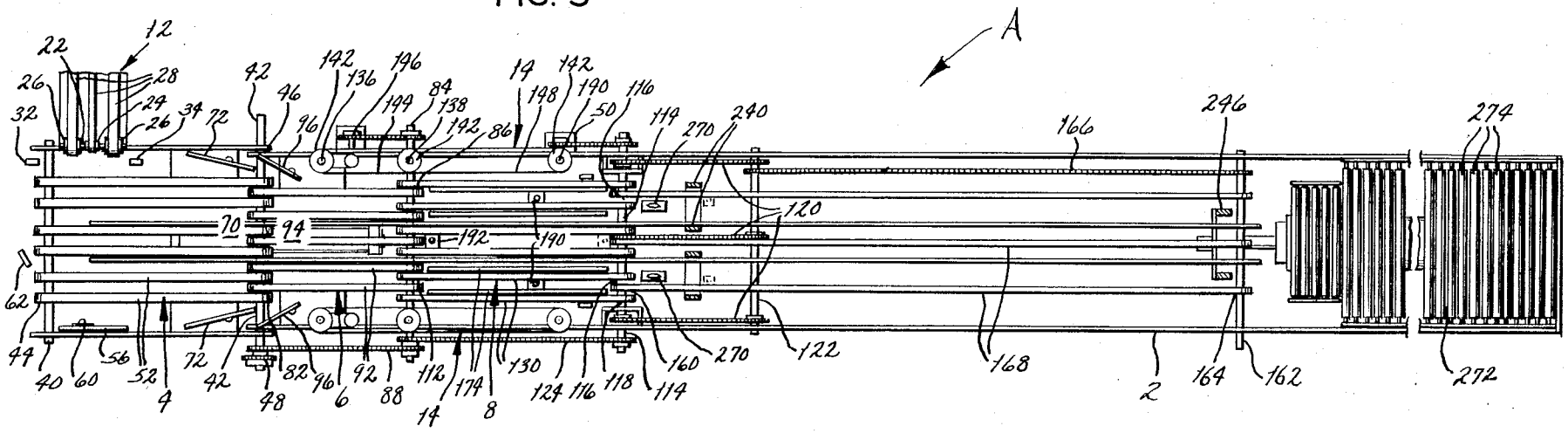
FIG. 3 is essentially a plan view of the machine taken along line 3—3 of FIG. 2.

The accumulating conveyor 8 causes further consolidation of the run or array of signatures s and also separates the run at a predetermined location to provide enough stacked signatures s that can be conveniently handled as a bundle b. The accumulating conveyor 8 includes (FIGS. 2 and 3) a series of timing pulleys 112 that are mounted upon the shaft 84 between the pulleys 86 that are also on that shaft 84. The pulleys 112 are the same diameter as the pulleys 86, but in contrast to the pulleys 86 they are free to rotate on the shaft 84. In addition, the accumulating conveyor 8 includes three axially aligned shafts 114 which are located downstream from and at the same elevation as the shaft 84. They are also parallel to the other shafts 84, 42 and 40. While the three shafts 114 rotate about a common axis, the adjacent ends of the shafts 114 do not meet, but instead narrow spaces 116 exist between those adjacent ends, there being a separate space on each side of the centerline for the conveyor 8. The shafts 114 are fitted with timing pulleys 118, and each pulley 118 aligns with a different pulley 112 on the preceding shaft 84. The pulleys 118 are fitted firmly to the shafts 114 so that they will rotate with the shafts 114, and each of the shafts 114 is connected by means of a sprocket and chain drive 120 (FIG. 3) to a jack shaft 122 which extends across the main frame 2 in the region of the final conveyor 10. Also, one of the shafts 114 is connected to the shaft 84 by another sprocket and chain drive 124 (FIG. 3). The arrangement is such that the three shafts 114 are connected together and revolve at the same velocity which is normally slightly less than the velocity of the shaft 84. Moreover, the sprocket at which the sprocket and chain drive 124 is connected to one of the shafts 114 contains a clutch which will enable that one shaft 114, as well as the other shafts in alignment with it, to revolve faster than the velocity at which the shaft 84 will propel the shafts 114 when the power is transmitted through the sprocket and chain drive 124. Indeed, the jack shaft 122 is connected by still another sprocket and chain drive 126 to a secondary gear motor 128 which when energized turns the three aligned shafts 114 at a somewhat greater velocity than the velocity imparted to them by the other motor 50.

Extended around the aligned pairs of timing pulleys 112 and 118 are double tooth timing belts 130 (FIGS. 2 and 3), the upper surfaces of which form a horizontal continuation of the horizontal conveying surface formed by the upper passes of the belts 92 for the consolidating conveyor 6. The upper passes of the belts 130 furthermore pass over and are supported on skid plates which prevent the belts 130 from sagging. The sprocket and chain drive 124 normally drives the belts 130 at a velocity slightly less than that of the belts 92 of the consolidating conveyor 6, the speed ratio again being about 2:3. Indeed, the belts 130 of the accumulating conveyor 8 operate at about 50% of the speed for the belts 52 for the orienting conveyor 4. However, at periodic intervals the motor 128 is energized to increase the speed of the belts 130 so that they move faster than the belts 92. This increase in speed lasts for only a short duration and has the effect of producing a gap g (FIG. 6) in the run of signatures s, this gap of course occurring at the juncture between the two conveyors 6 and 8, that is, in the region of the shaft 84.

Mounted on the main frame 2 along the sides of the consolidating and accumulating conveyors 6 and 8 are side conveyors 14 (FIGS. 2 and 3), each of which includes three vertical shafts 136, 138, and 140 which are arranged in that order along the direction of advance for the conveyors 6 and 8 and are fitted with pulleys 142 of equal diameter. The shafts 136 for the two side conveyors 14 are located immediately beyond the deflecting plates 96 that form the second gate 94, whereas the shafts 138 are located directly above the shaft 84 that separates the consolidating and accumulating conveyors 6 and 8. The pulleys 142 on the shafts 136 are attached firmly to the shaft 136 and align with corresponding pulleys 142 on the shafts 138, and extended around these pulleys 142 are side belts 144. The side conveyors 14 are adjustable inwardly and outwardly on the frame 2, and when properly positioned, the inner passes of the side belts 144 are spaced apart a distance that is no less than and perhaps slightly greater than the width of the second gate 94 at the leading end of the deflecting plates 96. The shafts 136 are driven from the shaft 84 through a drive train 146 (FIGS. 1 and 3), with the arrangement being such that the inner passes of the side belts 144 move at the same velocity and in the same direction as the upper passes for the belts 92 of the consolidating conveyor 6.

The third shaft 140 on each side of the accumulating conveyor 8 is set slightly to the rear of the three aligned shafts 114 that mark the juncture between the accumulating conveyor 8 and the final conveyor 10. The pulleys 142 on the shafts 136 are attached firmly to the shafts 136 and are offset vertically from the pulleys 142 around which the side belts 144 pass. Indeed, they align with more pulleys 142 on the shafts 138, and extended around the corresponding pulleys 142 of the two shafts 138 and 140 on each side of the accumulating conveyor 8 are more side belts 148. The shafts 140 are driven from the jack shaft 122 through a drive train 150 (FIGS. 1 and 3), with the arrangement being such that the inner passes of the side belts 148 always move at the same velocity and in the same direction as the upper passes of the belts 130 for the accumulating conveyor 8. To this end, the pulleys 142 on the intermediate shafts 138 are free to rotate with respect to that shaft, thus enabling the belts 144 and 148 to move at different velocities.

Thus, while the run of signatures s is along the consolidating conveyor 6 it is advanced not only by the belts 92 of the conveyor 6, but also by the belts 144 of the side conveyors 134. Likewise when the signatures s are along the accumulating conveyor 8 they are advanced by the belts 130 of the conveyor 8 as well as the belts 148 of the side conveyors 134. When the secondary gear motor 128 temporarily increases the speed of the belts 130 to create the gap g in the run of signatures s, the belts 148 also accelerate. The side conveyors 134, or more specifically the belts 144 and 148 of those conveyors, further serve to keep the signatures s upright along the consolidating and accumulating conveyors 6 and 8.

To insure that the leading signatures s in the run of signatures s do not topple forwardly as they move along the consolidating and accumulating conveyors 6 and 8, the frame 2 is fitted with elongated members 156 (FIGS. 2 and 5) which project over the side conveyors 134 and the signatures s along those conveyors. The members 134 have highly flexible straps 158 depending from them at frequent intervals and these straps lie in the path of the signatures s so as to hold the leading signatures s upright.

The final conveyor 10 is much like the preceding conveyors 6 and 8, except that it is considerably longer. It includes pulleys 160 (FIGS. 2 and 3) that are fitted to the aligned axle shafts 114, alternating with the drive pulleys 118 on those shafts and being of the same diameter. However the pulleys 160 are not fixed to the shaft 114, but instead are connected to it by clutches that enable the pulleys 160 to rotate forwardly on the shafts 114 at a speed greater than the shafts 114, but do not let them rotate any slower than the shafts 114. Near the forward end of the main frame 2, another axle shaft 162 extends across the frame 2, and that shaft is parallel to and at the same elevations as the shaft 114. The shaft 142 is fitted with timing pulleys 164 that are the same diameter as the pulleys 160, and indeed each pulley 164 is positioned to align with a separate pulley 160. The shaft 142 and the jack shaft 122 are connected by means of a sprocket and chain drive 166. Extended around each pair of aligned pulleys 160 and 164 is a single sided timing belt 168, the upper passes of which are supported on skid plates to prevent them from sagging under the weight of the signatures s. Indeed, the upper passes of the belts 168 form a continuation of the upper passes on the belts 130 of the accumulating conveyor 8. Being single sided, the belts 168 do not have teeth on their outwardly presented surfaces. This enables the belts 168 to slide easily under a bundle b of signatures s.

The belts 168 of the final conveyor 10 normally operate at the same speed as the belts 130 of the accumulating conveyor 8, so that the signatures s will pass without interruption onto the final conveyor 10.

Between adjacent belts 130 of the accumulating conveyor 8 are skids 174 (FIGS. 2–4 and 6) which are supported on pneumatic cylinders 176 that are mounted on the main frame 2. The skids 174 extend substantially the entire length of the accumulating conveyor 8 and have low friction upper surfaces that are normally below the upper passes of the timing belts 130 for the conveyor 8. When so disposed they permit the signatures s to ride on the upper passes of the belts 130 and to be advanced at the speed of the belts 130. However, when the supporting cyliners 176 are energized, they elevate the skids 174 sufficiently to bring the upper surfaces of the skids 174 slightly above the upper surfaces of the belts 130. The skids 174, of course, lift the signatures s upwardly off of the belts 130, but only those signatures s that are separated into a bundle b by the increase in speed of the belts 130 are elevated. When supported on the skids 174, the bundle b may be pushed with relative ease along the skids 174 and onto the final conveyor 10 (FIGS. 7*b* and *c*).

The movement along the skids 174 is effected by the pusher unit 16 (FIGS. 2 and 5) which includes pneumatic cylinder 180 having a barrel 182 that is secured firmly to the frame 2 and a piston rod 184 that moves into and out of the barrel 182. The barrel 182 is located generally beneath the orienting and consolidating conveyors 4 and 6 and is centered midway between the sides of those conveyors such that the piston rod 184 moves parallel to the upper passes of the belts 130 for the accumulating conveyor 8. The piston rod 184 is connected to a slide 186 which moves on ways 188 that are fastened firmly to the frame 2, the ways 188 likewise being parallel to the upper passes of the belts 130.

Figure 2:
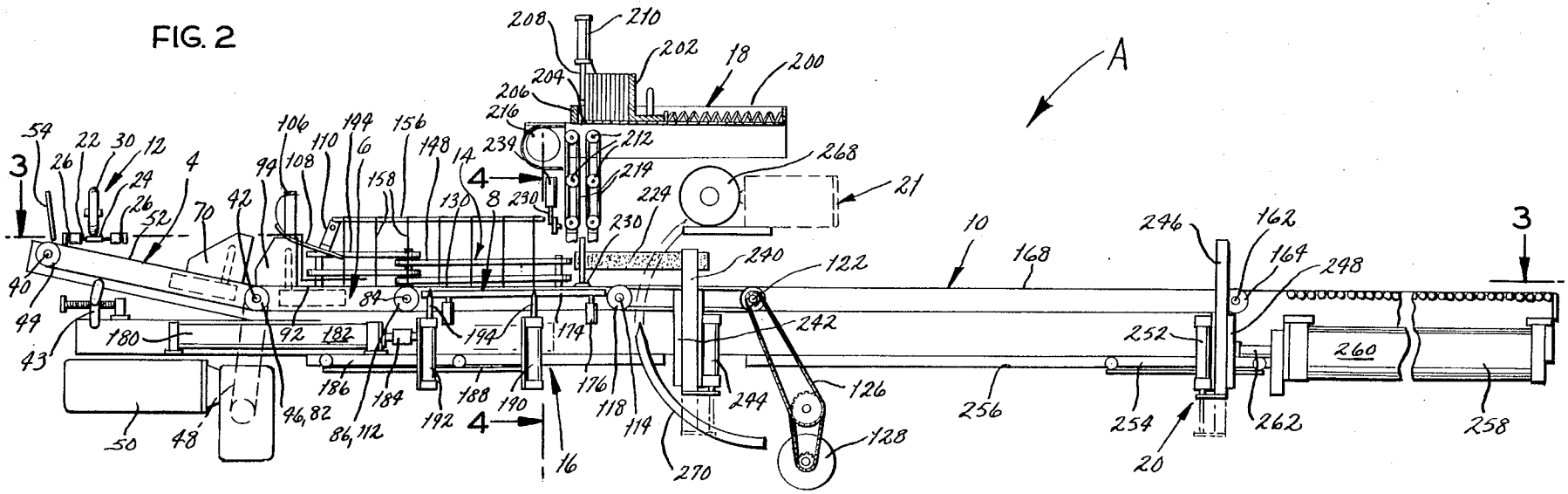
FIG. 2 is a sectional view taken along line 2—2 of FIG. 1 and showing the machine essentially in elevation.

The slide 186 supports three relatively small pneumatic cylinders, namely two forward cylinders 190 and a single rear cylinder 192 (FIGS. 2 and 3), each being double acting and mounted with its axis vertical and therefore perpendicular to the plane of the overlying belts 130. Moreover, each cylinder 190 and 192 includes a push pin 194, which is actually an extension of its piston rod, and this pin extends or retracts when its particular cylinder 190 or 192 is energized. When retracted the pin 194 lies fully below the upper passes of the belts 130 and will not interfere with the movement of signatures s along those belts 130. However, when extended the pin 194 will project above the belts 130 to an elevation almost as high as the upper margins of the signatures s. The two forward cylinders 190 are positioned on the slide 186 such that they align with the spaces 116 between the adjacent ends of the aligned shafts 114 at the end of the accumulating conveyor 8 (FIG. 3), and indeed the pins 194 of the forward cylinders 190 will pass through those spaces 116 as the rod 184 of the main cylinder 180 moves to its fully extended position. The single rear cylinder 192 aligns with the space between the two centermost belts 130 of the accumulating conveyor 8. When the rod 184 of the main cylinder 180 is fully retracted, the push pin 194 of the rear cylinder 192 is located immediately ahead of the shaft 84 at the juncture of the consolidating and accumulating conveyors 6 and 8 (FIG. 2). It is thus in a position to project into the gap g formed in the run of signatures s when the belts 130 of the accumulating conveyor 8 are momentarily accelerated. The push pins 194 of the forward cylinders 190, when the slide 186 is rearmost, are located generally midway between the shaft 84 and the aligned shafts 114. In this position they are to the rear of the region where the board inserter 18 deposits the boards b on the accumulating conveyor 8.

On the other hand, when the piston rod 184 of the cylinder 180 is fully extended (FIGS. 7*c* and *g*) the push pin 194 of the rear cylinder 192 is immediately behind the center of the three aligned shafts 114 while the push pins 194 of the forward cylinders 190 are along the final conveyor 10, slightly behind the jack shaft 122 and ahead of the three aligned shafts 114. Indeed, as the piston rod 184 moves from its retracted position to its extended position, the pins 194 of the forward cylinders 190 pass between the spaces 116 between adjacent ends of the aligned shafts 114.

The piston to which the rod 184 is connected is fitted with a magnet (not shown), and as the rod 184 moves between its retracted and extended positions, the magnet passes by and activates various reed switches (not shown) on the cylinder barrel 182 which is made from a non-ferrous material. The reed switches in turn are in the control circuitry for the machine A and serve to initiate or terminate various operations.

Initially the piston rod 184 of the main cylinder 180 for the pusher unit 16 is in its retracted position (FIG. 7*a*) as are the push pins 194 for the forward and rear cylinders 190 and 192. Immediately after the accumulating conveyor 8 accelerates to momentarily create the gap g in run of signatures s, the rear cylinder 190 is energized to extend its push pin 194 into the gap g (FIG. 7*b*). At the same time the cylinders 176 are energized to elevate the skids 174 and lift the signatures s that are along the conveyor 8 off of the conveyor belts 130. Then the main cylinder 180 is energized and its piston rod 184 drives the slide 186 forwardly and forces the segregated signatures s, which is actually a bundle b, off of the accumulating conveyor 8 and onto the final conveyor 10 (FIG. 7*c*). To this end the piston rod 184 is extended to its fullest extent so that the push pin 194 of the rear cylinder 192 drives the signatures s to the region of the three aligned shafts 114 that form the juncture between the accumulating and final conveyors 8 and 10. Next the piston rod 184 retracts to its fullest extent and likewise so does the push pin 194 of the rear cylinder 192. When the rod 184 is fully retracted, the push pins 194 of the forward cylinders 190 elevate (FIG. 7*d*). Then the rod 184 is again extended, but only enough to drive the push pins 194 of the forward cylinders slightly beyond the three aligned shafts 114 (FIG. 7*e*). This provides enough clearance behind the bundle b to enable the board inserter 18 to deposit a board behind the bundle b without interfering with the last signatures s in the bundle b. Once the board c is in place, the push pins 194 of the forward cylinders 190 retract, and the piston rod 184 of the main cylinder 180 moves the slide 186 rearwardly. Indeed, the slide 186 moves back to its initial position, that is the position in which the piston rod 184 is fully retracted. In this position the push pins 194 of the forward cylinders 190 are to the rear of the board c that is over the accumulating conveyor 8. The forward cylinders 190 are again energized to extend their push pins 194 (FIG. 7*f*), whereupon the main cylinder 180 is energized, so that its piston rod 184 again moves the slide 186 forwardly. The extended pins 194 bear against the board c deposited by the inserter 18 and move that board forwardly against the rearmost signature s in the bundle b. Indeed, the rod 184 of the main cylinder 180 extends to its fullest extent and drives the entire bundle b further onto the final conveyor 10 (FIG. 7*g*).

The board inserter 18 is located generally above the feed end of the final conveyor 10, but deposits the boards c onto the accumulating conveyor 8 near the discharge end of that conveyor. In particular, the inserter 18 will position a board c in an upright position over the belt 130 of the accumulating conveyor 8 such that the board c will be located ahead of the forward cylinders 190 when the slide 186 is fully retracted (FIGS. 2 and 7*f*). The boards c are lowered in a sequence which places one in the path of an expanding run of signatures s and another at the end of a separated bundle b of signatures s.

The board inserter 18 is supported on the main frame 2 and includes (FIGS. 1 and 2) a rack 200 in which the boards are placed on edge, one after the other, so that they stand upright above the conveyors 8 and 10. The rack 200 contains a spring loaded push plate 202 that urges the boards c toward one end of the rack 200 and maintains them in a compacted condition. At the end toward which the boards c are urged, the bottom of the rack 200 is provided with cutouts 204 that are sufficiently wide to enable one board c at a time to drop downwardly toward the belts 130 of the accumulating conveyor 8. Along the cutouts 204 are stops 206 toward which the push plate 202 urges the boards C. However, the endmost board c is normally prevented from contacting the stops 206, for it is restrained by plungers 208 that are in effect extensions of piston rods for pneumatic cylinders 210 which are also mounted on the rack 200 (FIG. 2). These plungers 208 are located directly above the cutouts 204 and extend and retract vertically. When extended, the plungers 208 prevent the boards c from reaching the cutouts 204 and the stops 206 that are along them. However, when retracted the plungers 208 are elevated entirely above the boards c, and the endmost board c will be forced against the stops 206 by the push plate 202. When so disposed the endmost board c is above the cutouts 204, but does not drop through them owing to the friction with the stops 206. On the contrary, the cylinders 210 must be energized to extend the plungers 208 and thereby force the endmost board downwardly through the cutouts 204.

Below the cutouts 204 of the rack 200 are sheaves 212 (FIG. 2) around which elastomeric belts 214 extend. The sheaves 212 are positioned such that the belts 214 are arranged in two sets with a vertical space between the inner passes of the belts 214 for the two sets. That space aligns with the cutouts 204 in the rack 200, and leads downwardly toward the belts 130 on the accumulating conveyor 8. It is also slightly narrower than the thickness of boards c so that any board c that is forced into the space will be tightly gripped by the belts 214 at their inner passes. The space between the lowermost sheaves 212 and the portions of the belts 214 that pass around them is slightly greater than the height of the signatures s. One sheave 212 of each set is connected to and turned by a motor 216 such that the inner passes of the two sets of belts 214 move downwardly at the same velocity.

Thus, when the pneumatic cylinders 210 retract their respective plungers 208, the endmost board c will move against the stop 206 and into alignment with the cutouts 204. At the appropriate time, the cylinders 210 are again energized, this time to extend the plungers 208. The plungers 208 force the endmost board c through the cutouts 204 and into the space between the inner passes of the two sets of belts 214, whereupon the belts 214 grip the board c and lower it in a controlled manner down to the accumulating conveyor 8.

Actually, the belts 214 do not deposit the board c on the belts 130 of the accumulating conveyor 8, but instead lower it onto slight bosses 220 (FIGS. 2 and 4) that are mounted on the frame 2 immediately to the sides of the accumulating conveyor 8. The bosses 220 support the board c with its lower edge slightly above the upper passes of the belts 130, so that the moving belts 130 do not grip the board c and move it along toward the final conveyor 10. Instead, they allow the board c to remain in position for ultimately coming in contact with a growing run of signatures s or with extended push pins 194 of the forward cylinders 190 for the pusher unit 16. To prevent the signatures s from snagging on the bosses 220, the leading edges of the bosses 220, as well as their trailing edges, are beveled. Thus, the signatures s along their sides merely rise slightly at the bosses 220, but nevertheless are pushed along by the preceding signatures which remain engaged with the belt 130.

The frame 2 also carries passive supporting devices 224 (FIGS. 2, 4 and 6) which extend along the sides of the accumulating and final conveyors 8 and 10, generally from the region of the bosses 220 to the region of furthest advance for the push pins 194 of the forward cylinders 190 on the pusher unit 16. Each of these devices includes a rigid backing 226 that is mounted on the frame 2 and bristles 228 which project from the backing 226 over the conveyors 8 and 10. While the spacing between the backings 226 on each side of the conveyors 8 and 10 is greater than the width of the signatures s, the spacing between the ends of the bristles 228 is not. Thus, as a board c is lowered by the board inserter 18 onto the bosses 220, it will pass into the bristles 228 of the passive support devices 224. The bristles 228 keep the board c in an upright position after it is released from the belts 214 of the inserter 14 and maintain it in that position as it travels onto the final conveyor 10, assuming it is at the front of a run of signatures s. The bristles also keep the rearmost signatures s of a bundle b upright after push pins 194 of the cylinders 190 and 192 have been withdrawn from them during the sequence of involving the insertion of a board c at the rear of the bundle b.

Immediately ahead of the location at which the boards c are lowered to the accumulating conveyor 8 are sweeper arms 230 (FIG. 4) which are normally stored above the run of signatures s, but will sweep downwardly and outwardly to somewhat straighten the rearmost signatures s of a bundle b before the pins 194 of the forward cylinders 190 are extended with the slide 186 in its retracted position. This ensures that the pins 194 of the forward cylinders 190 will rise behind the rearmost signature s of the bundle b. The arms 230 pivot on brackets 232 which are supported on the frame 2 and are actuated by small pneumatic cylinders 234. The pivots are located near the sides of the conveyor 8 and far enough above the belts 130 to enable the arms 230 to be stored in a position that will not interfere with the movement of the signatures s along the conveyor 8. However, once the center of the last signature s in the bundle b has cleared the arms 230, the cylinders 234 are energized. They sweep downwardly and outwardly so that the side edges of the last signature s does not trail into a position that will cause it to interfere with the extension of the push pins 194 from the forward cylinders 190.

The compression unit 20 is positioned beneath the final conveyor 10 and includes (FIG. 2) stop bars 240 which are located between the aligned shafts 114 and the jack shaft 122 and move upwardly and downwardly along guides 242, the movement being effected by a double acting pneumatic cylinder 242 to which all of the bars 240 are attached. When lowered, the bars 242 are completely below the upper passes of the flat belts 168 of the final conveyor 10 (FIG. 76). However, when elevated, the bars 240 project upwardly above the belts 168 and serve as a backing for the board c at the rear of the bundle b previously pushed onto the final conveyor 10 by the push pins 194 of the forward cylinders 190 for the pusher unit 16 (FIG. 7*h*). The bars 240 are offset laterally from the push pins 194 of the two forward cylinders 190 (FIG. 3) and are set slightly rearwardly of the position of farthest advance for those push pins 194. This enables the pins 194 of the cyliners 190 to advance the board c far enough to permit the stop bars 240 to rise behind the board c and form a solid backing for it and the signatures s which lie ahead of it.

In addition, the compression unit 20 includes front compression bars 246 (FIG. 2) which move upwardly and downwardly along guides 248, this movement likewise being effected by a double acting pneumatic cylinder 252. Both the guides 248 and the cylinder 252 are fastened to a slide 254 which moves along ways 256 that are fixed firmly to the frame 2. The cylinder 252 moves the bars 246 from a retracted position wherein they are entirely below the upper passes of the belts 168 for the final conveyor 10 (FIG. 7*a*) to an extended position wherein they project above the upper passes of the belts 168 sufficiently to bear against the board c at the front of a bundle b on the final conveyor 10, assuming of course that the slide 254 is moved toward the feed end of the machine A (FIG. 7*h*). This movement for the slide 254 is provided by a double acting compression cylinder 258 including a barrel 260 that is fixed firmly to the frame 2 and a piston rod 262 that is attached to the slide 254.

Thus, when the piston rod 262 of the cylinder 258 is extended with the compression bars 246 in an elevated position, the compression bars 246 will in time contact the leading board c on the bundle b (FIG. 7*g*). Further extension of the piston rod 262 will cause the entire bundle b to compress to a shorter length between the rear stop bars 240 and the front compression bars 246 (FIG. 7*h*). The barrel 260 of the cylinder 258 is provided with a pressure sensor, and when this sensor registers a predetermined pressure within the barrel 260, the supply of air to the barrel 260 is terminated, and the barrel 260 is maintained at the predetermined pressure. Hence, the bundle b is maintained in a compressed condition on the final conveyor 10, between the stop bars 240 and the compression bars 246 of the compression unit 20. The flat belts 168 of the final conveyor 10 continue to move beneath the bundle b, but do not advance it because of the presence of the compression bars 246.

During the short interval that the bundle b is compressed at the compression unit 20, the binding apparatus 21 ties twine t around the bundle b, with that twine t extending along the top and bottom surfaces of the bundle b and vertically across the boards c. The twine t is knotted along the upper edge of the trailing board c. In this regard, the binding apparatus 21 is for the most part conventional in that it is essentially a typing machine for hay bales. As such it includes (FIG. 2) a knotter 268 which is located above the final conveyor 10 at about the elevation of the top surface of the bundle b. It also includes needles 270 which are located below the final conveyor 10 and swing upwardly from a position completely below the upper passes of the belts to a position opposite the knotter 268. Each needle 270 carries twine 5 with it and when in its upper position is disposed such that the knotter 268 will engage the twine t and create a knot that secures the twine around the bundle b.

More specifically each twine t is held by the knotter 268 and extends from it downwardly to the free end of a needle 270 through which it passes, the spool or other source from which the twine t is derived being located beyond the needle 270. Thus, when the needle 270 is in its lower position below the conveyor 10, the twine t will depend from the knotter 268 across the path of the signatures s as they advance onto the final conveyor 10 (FIG. 72). As the board c at the leading end of the bundle b passes beyond the bristles 228 of the passive support devices 224 it comes into contact with the twine t and draws the twine t through the ends of the needles 270 as the run of signatures s continues to grow and likewise as the bundle b is segregated and pushed onto the final conveyor 10 (FIGS. *7b–g*).

In effect the twine t is laid over and under the run of signatures s and the bundle b that it eventually becomes as well as across the board c at the leading end. Moreover, at a location ahead of the needles 270 the twine t is maintained under a slight amount of tension. All of this enables the signatures s and the leading board c to advance along the final conveyor 10 without having the leading board c or the signatures immediately behind it topple.

Once the bundle b is completely formed with its full complement of signatures s and its leading and trailing boards c properly positioned, the compression unit 20 compresses the bundle b between its stop and compression bars 240 and 246. Only then do the needle 270 rise through the final conveyor 10 to the knotter 268 (FIG. *7g*). The needles 270 bring their respective twine t upwardly across the trailing board c and position it such that the knotter 268 can grip it and create knots. In addition, the knotter 268 cuts the twine t beyond the knots and grips the cut off portion so that the twine t continues to extend between the knotter 268 and needles 270 to be in position to extend around the next bundle b that is formed (FIG. *7a*).

The binding apparatus 21 may be derived from a Holland tier, a conventional item of farm equipment.

Beyond the final conveyor 10 is a platform 272 (FIGS. 1–3) that is in essence a series of rollers 274. After the binding apparatus 21 ties the knots in the twine t, the barrel 260 of the compression cylinder 258 is vented, and indeed its piston rod 262 is retracted. Also the cylinder 244 lowers the compression bars 246. This enables the final conveyor 10 to propel the tied bundle b onto the platform 272 (FIG. *7a*), where it is removed from the machine A.

The machine A includes a control circuit which energizes the various pneumatic cylinders and motors at the proper time and further controls the speed of the gear motor 50. The light sensors 34 and 64 form part of the circuit.

OPERATION

The operation of the stacking and bundling machine A begins with the deposit of the signatures s onto the feed conveyor 12 such that the longest margins of the signatures s are parallel to the belts 28 of the conveyor 12. The signatures s move along the feed conveyor 12 in a shingled condition (FIG. 6) and at the discharge end of the feed conveyor 12 are fluted slightly between their sides by the pressure wheel 30 (FIG. 5). While in the fluted condition, the signatures s pass off of the feed conveyor 12 and outwardly over the top surface of the inclined orienting conveyor 4 where they accumulate in a pile of somewhat horizontal disposition. In this regard, each time a signature s is projected beyond the end of the feed conveyor 12 it acquires some rigidity in view of the flute that is imparted to it, but eventually its leading end drops down and contacts the signature s that is immediately below it on the pile that has accumulated. The discharged signature s then slides across the lower signature s until it contacts the stop 56 which in effect arranges all the signatures s of the pile with their end edges, and their side edges as well, generally in registration.

As the signatures s drop downwardly to the orienting conveyor 4 they interrupt the beam of light projected from the light source 32 (FIG. 2) and this interruption is observed by the sensor 34, which produces an electrical signal that registers as a count in the control circuitry of the machine A. In this manner the signatures s that are delivered to the orienting conveyor are counted. It is also possible to derive the count from the press that supplies the signatures that are stacked in the machine A.

The belts 52 of the orienting conveyor 4 withdraw the signatures s from the pile that accumulates at the feed end of that conveyor 4 and move those signatures s toward the first gate 70 in a shingled condition (FIGS. 5 and 6). In this regard, the belts 52 of the orienting conveyor 4 have teeth projecting outwardly from them, inasmuch as they are double tooth timing belts, and these teeth grip the signatures s individually from beneath the pile. As a consequence, the signatures s are arranged one after the other in a shingled condition along the orienting conveyor 4. Even though the orienting conveyor 4 is inclined downwardly away from its feed end, the short pile of signatures s that accumulates at the feed end is in a generally horizontal disposition because of the shingled condition of the signatures s which underlie the pile.

The orienting conveyor 4 moves the shingled signatures s into the first gate 70 where the end edges of the signatures s contact the converging deflecting plates 72 and are urged inwardly. This causes the signatures s to bow forwardly (FIG. 6) and to further move gradually to a generally upright condition insofar as the belts 52 of the orienting conveyor 4 are concerned (FIG. 5). Indeed, at the leading edges of the gate 70 the signatures s emerging from the gate 70 are totally on edge, standing perpendicular to the belts 52, while the signatures s preceding it in the gate 70 and along the orienting conveyor 4 are inclined at progressively lesser angles.

The signatures s after emerging from the first gate 70 pass onto the consolidating conveyor 6 which advances them through the second gate 94. Here the forwardly directed bow in the signatures s is intensified (FIG. 6), since the second gate 94 is narrower than the first gate 70, and this enables the signatures s to stand on edge without tending to fall over. Indeed, the bowed signatures s on the consolidating conveyor 6 form a backing which prevents the signatures s from toppling out of the first gate 70 at the end of the orienting conveyor 4. Moreover, the speed of the consolidating conveyor 6 is slightly less than the speed of the orienting conveyor 4, so the signatures s tend to move together or consolidate on the consolidating conveyor 6. Also, at the second gate 94, the signatures s pass under the vibrating plate 108 (FIG. 5) which brings upper and lower margins of the signatures s into registration.

Immediately beyond the second gate 94, the signatures s pass between the belts 144 for the side conveyors 14, and the inner passes of those belts 144, being closer together than the width of the signatures s, cause the signatures s to remain in a bowed configuration along the rest of the consolidating conveyor 6 (FIG. 5). The same holds true as the signatures s move along the accumulating conveyor 8, for belts 148 line the accumulating conveyor 8 for almost its entire length.

As the leading signatures s move out from beneath the vibrating plate 108 they encounter the straps 158 which depend from the elongated members 156 (FIG. 5). The straps 136, together with the bowed distortion of the signatures s maintain the leading signatures s in an upright position so they do not topple forwardly while on the consolidating and accumulating conveyors 6 and 8.

Figure 7A:
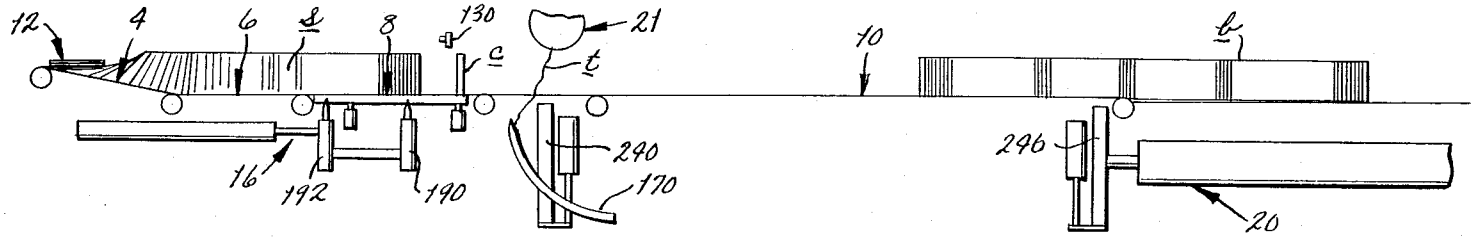
Figure 7B:
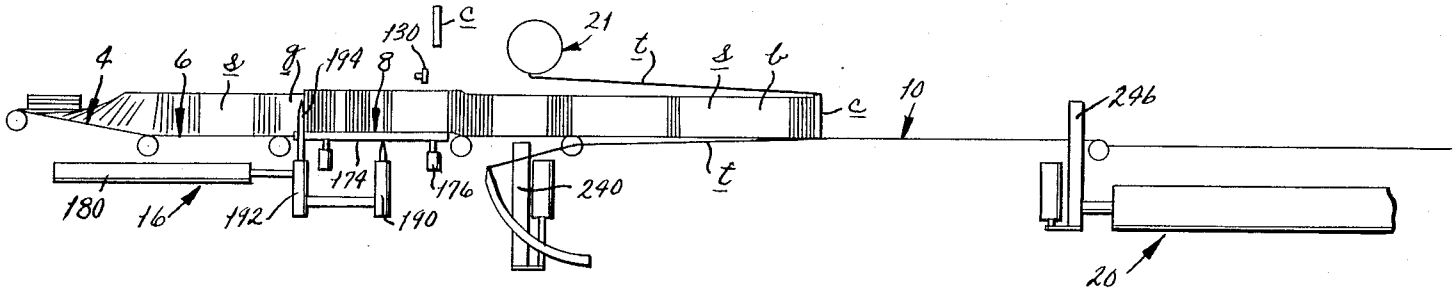
Figure 7C:
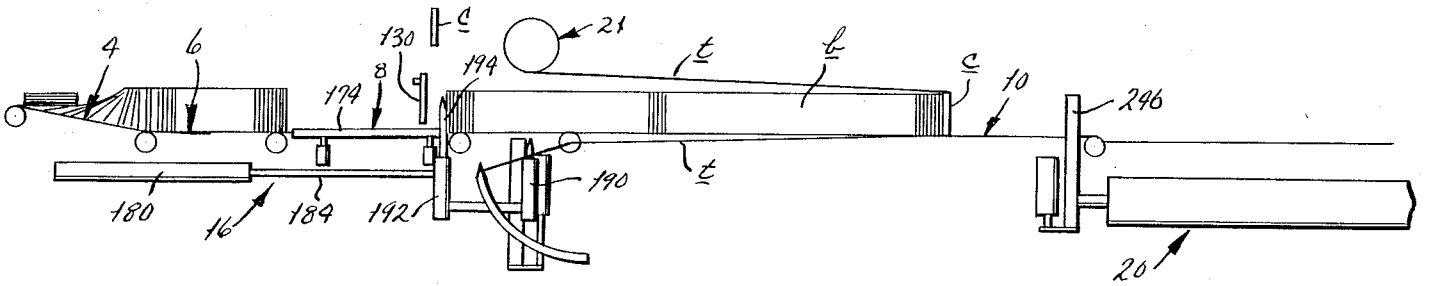
Figure 7D:
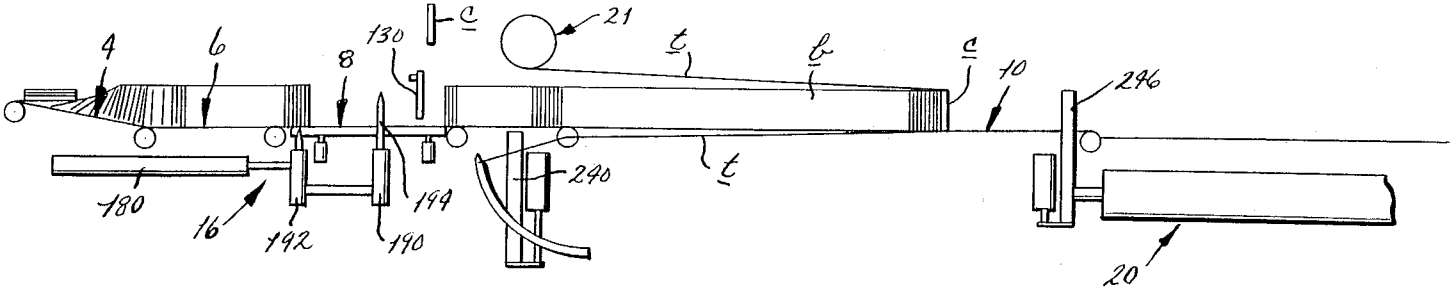
Figure 7E:
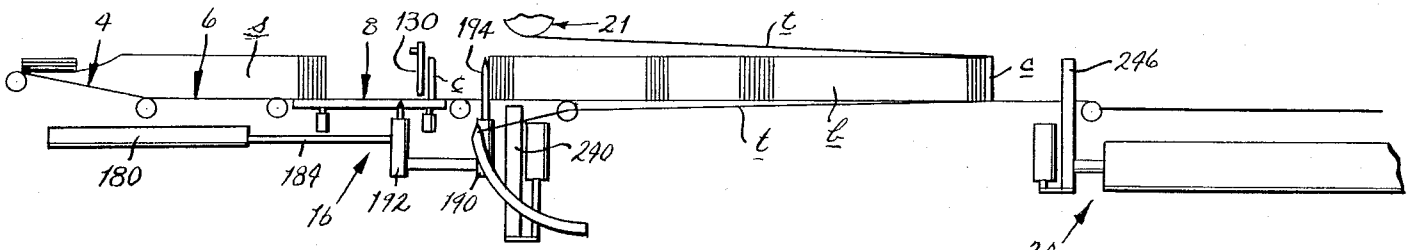
Figure 7F:
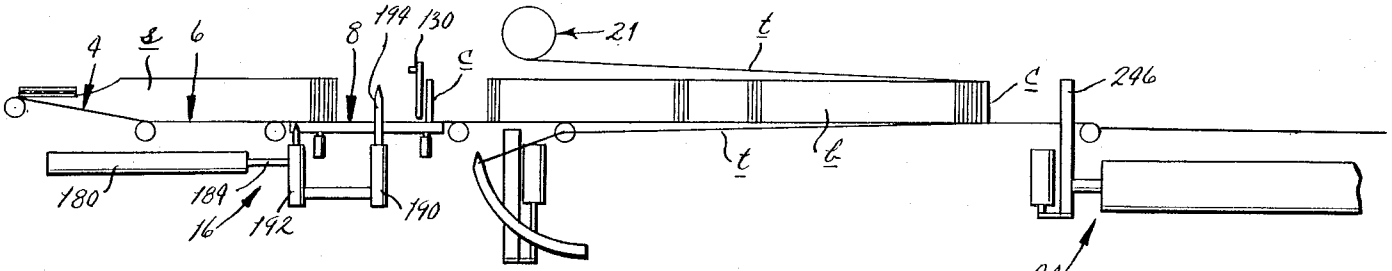
Figure 7G:
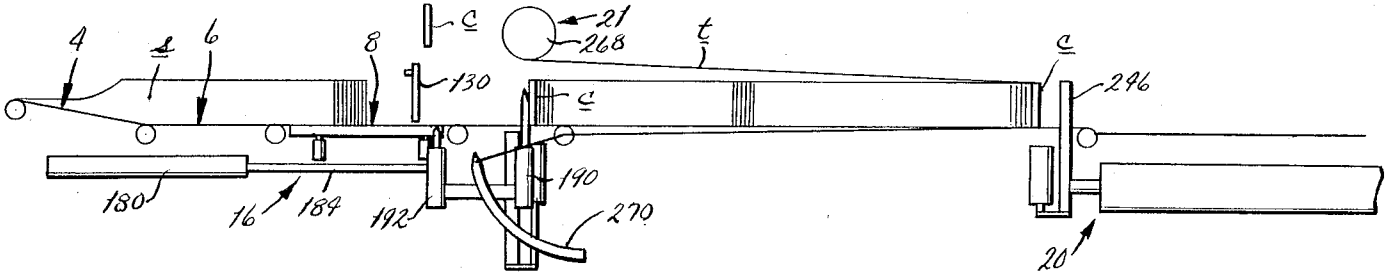
Figure 7H:
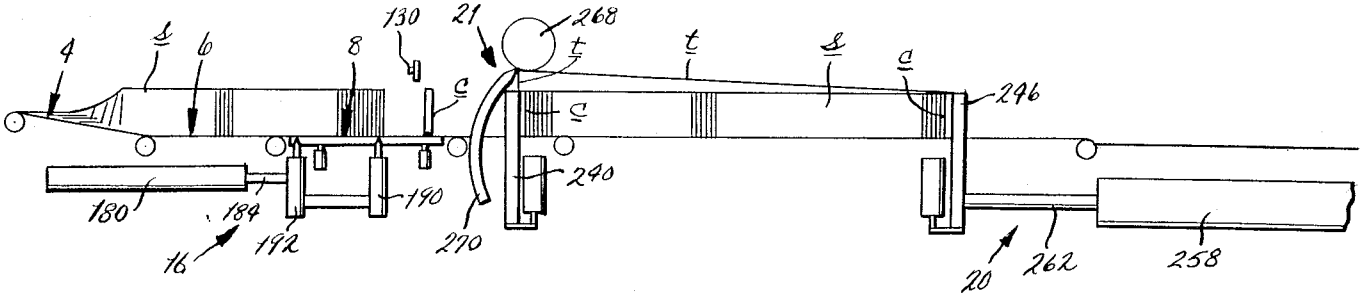

During the interval that the signatures s accumulate on the accumulating conveyor 8, that is while the leading end of the run of signatures s moves along the accumulating conveyor 8, the board inserter 18 lowers a board c onto the bosses 220 that are directly beneath the delivery belts 214 of the inserter 14 (FIG. 7*a*). The bristles 228 of the passive support devices 224 contact the sides of the board c and maintain the board c in a upright position sightly above the moving belts 130 of the accumulating conveyor 8.

In time the accumulating conveyor 8 advances the leading signatures s of the run against the board c, causing the board c to dislodge from the bosses 220 and move ahead of the signatures s. The board c and leading signatures s thereafter move through the bristles 228 of the passive support devices 224 which keep them from toppling forwardly, and while confined by the support devices 224 they move onto the flat belts 168 of the final conveyor 10. Near the end of the passive support devices 224, the board c encounters the twine t that extends from the knotter 268 and the needles 270 of the binding apparatus 16, and since the twine t does not pay easily out of the needles 270, it remains under tension as the board c and signatures s continue to advance on the final conveyor 10 (FIGS. 6 and 7*b*). Thus, the twine t prevents the board c and leading signatures s from toppling over after they pass beyond the passive support devices 224.

In time, the control circuitry will register the appropriate number of counts desired for a bundle b, and at that time will generate a signal which momentarily energizes the secondary gear motor 128, which increases the speed of the belts 124 on the accumulating conveyor 8. This produces a gap g in the otherwise uninterrupted line of edge-standing signatures s (FIG. 6). During this time the piston rod 184 for the main cylinder 180 of the pusher unit 16 is in its retracted position, and thus the slide 186 is in its rearmost position. Once the gap g is formed in the run of signatures s, the control circuitry energizes the rear cylinder 192 of the pusher unit 16, causing it to project its push pin 194 upwardly through the spaces between the centermost belts 130 on the accumulating conveyor 8. The pin 194 extends into the gap g (FIG. 7*b*). Contemporaneously the cylinders 176 move the skids 174 upwardly between other pairs of adjacent belts 124 on the accumulating conveyor 8. This elevates the isolated signatures s that are along the accumulating conveyor 8 so that they are slightly above the belts 130 of the accumulating conveyor 8. When the signatures s are so disposed, the main cylinder 180 of the pusher unit 16 is energized to extend the piston rod 184 to its fullest extent. This drives the push pin 194 of the rear cylinder 192 to the end of the accumulating conveyor 8, and the push pin 194 in turn pushes the bundle b of signatures s essentially off of the accumulating conveyor 8 and onto the final conveyor 10, the trailing signatures s of the bundle b being located generally over the aligned shafts 114 which form the transition between the accumulating and final conveyors 8 and 10 (FIG. 7*c*). Of course, as the bundle b moves onto the final conveyor 10, more twine t pays out of the needles 270, but the twine t remains under tension and prevents the leading board c and leading signatures s from toppling forwardly.

Next, the sweeper arms 230 move downwardly and outwardly across the rearmost signature s (FIGS. 7*c, d*) and force the sides of the trailing signatures s forwardly past the push pin 194 of the rear cylinders 192 on the pusher unit 16, the slide 186 of which is in its forward or extended position. Then the piston rod 184 of main cylinder 180 for the pusher unit 16 retracts to bring the slide 186 back to its initial position. At the same time the push pin 194 of the rear cylinder 192 retracts, and so do the skids 174 that formerly supported the signatures s above the belts 130 of the accumulating conveyor 8.

While the sweeper arms 230 hold the sides of the trailing signatures s forwardly the forward cylinders 190 of the pusher unit 16 are energized to extend their push pins 194 which project upwardly between the belts 130 of the accumulating conveyor 8 so that they are positioned behind the trailing signatures s of the bundle b (FIG. 7*d*). Then the main cylinder 180 is energized, and it drives its piston rod 184 forwardly to a partially extended position (FIG. 7*e*). The extended push pins 194 of the forward cylinders 190 in turn force the bundle b still further forwardly, at least far enough to bring the sides of the trailing signatures s into the bristles 228 of the passive support device 224. As a result, the trailing signatures s remain in an upright position completely clear of the location at which the board inserter 20 deposits the boards c on the accumulating conveyor 8.

Next the push pins 194 of the forward cylinders 190 retract, and thereafter the piston rod 184 moves the slide 186 back to its initial or rearmost position. At the same time the board inserter 16 lowers a board c into the bosses 220 along the sides of the accumulating conveyor 8. The sweeper arms 230 remain down as the board c is lowered to prevent the board c from toppling rearwardly in the event that the bristles 228 of the passive support device 224 fail to hold it.

Once the board c is in place at the rear of the bundle b, the forward cylinders 190 of the pusher unit 16 are energized to extend their push pins 194 (FIG. 7*f*). Then the main cylinder 180 is again energized, and remains energized long enough to move its piston rod 184 to its fully extended position. As a consequence the slide 186 moves forwardly to its forwardmost position and the push pins 194 of the forward cylinders 190 dislodge the board c from the bosses 220 and move it forwardly against the rearmost signature s of the bundle b. Indeed, the pins 194 of the forward cylinders 190 drive the entire bundle b, signatures s as well as boards c, forwardly on the final conveyor 10 until the trailing board c is slightly ahead of the retracted stop bars 240 of the compression unit (FIG. 7*g*). This places the bundle b in position for compacting and binding.

Once the bundle b is in the compacting position, the cylinders 244 elevate the stop bars 240 so that they are located behind the trailing board c. Then the push pins 194 of the forward cylinders 190 for the pusher unit retract and the main cylinder 180 is energized to move the slide 184 back to its initial or rearmost position (FIG. 7*h*).

With the compression bars 246 on the slide 254 in an elevated position, the large cylinder 258 of the compression unit 20 is energized to move the bars 246 rearwardly against the leading board c of the bundle b. The compression bars 246 continue to move toward the stop bars 240, compressing the bundle b between the two sets of bars 240 and 246 (FIG. 7*h*). Once the air within the barrel 260 of the cylinder 258 reaches a predetermined pressure, the supply of air to the cylinder 258 is terminated, but its barrel 260 remains pressurized to hold the compression bars 246 in position so that the bundle b remains compressed.

While the bundle b is maintained in a compressed condition between the bars 240 and 242, the binding apparatus 21 is activated. In particular, the needles 270 move upwardly behind the trailing board c, and bring the twine t to the knotter 268 so that the twine t now extends completely around the bundle b (FIG. 7*g*). The knotter 268 engages the twine t from the needles 270 and ties it with the ends of the twine t already its grip. It further cuts the twine t beyond the knot that is so formed. The knotter 268, however, continues to grip the cut end of the twine t so that the twine t remains extended between the knotter 268 and the needles 270 as the needles 270 move back to their initial position, which they do after the knot is completed.

Once the bundles b are bound at the binding apparatus 18, the large cylinder 258 of the compression unit 20 moves the slide 254 back to its initial position and the bars 240 and 242 are retracted by their respective cylinders 244 and 252. This releases the bundle b and enables the belts 168 of the final conveyor 10, which belts have been moving under the bundle b for the whole time, to transfer the bundle b to the platform 272 where it can be retrieved (FIG. 7*a*).

In the meantime, the board inserter 14 will have lowered another board c onto the conveyor 8 and more signatures s will have advanced along the conveyor 8 toward the board c (FIG. 7*a*), thus enabling the machine A to repeat the foregoing sequence. Indeed, the sequence is repeated enough times to produce sufficient bundles b for the particular magazine issue or book that is to be assembled at the binding machinery.

While the machine A has been described in conjunction with signatures s that are delivered from a printing press, the machine A may also be used to stack and bundle any type of flexible sheets that are of generally equivalent size. Also, the signatures s need not be delivered at the side of the orienting conveyor 4, but instead may be advanced to the orienting conveyor 4 in the direction that the orienting conveyor 4 moves and merely dropped downwardly over the end of the conveyor 4.

With slight modifications the machine A can also be used to convert a stack of signatures s into a run of shingled signatures s. The modifications involve, eliminating the gates 70 and 94, the side conveyors 14, the pusher unit 16, the board inserter 18, the compression unit 20, and the binding apparatus 21, or at least rendering these components ineffective as to the signatures s passing along the conveyors 4, 6, 8, and 10. The modifications also involve operating each of the conveyors 4, 6, 8 and 10 at progressively greater speeds. Thus, a stack of signatures s that is placed on the end of the orienting conveyor 4 will be converted into a shingled condition, for the belts 52 of the orienting conveyor 4 will withdraw the signatures s from the bottom of the stack such that they are in a slight shingled arrangement, and the subsequent conveyors 6, 8, and 10, all of which operate at progressively greater speeds, will spread the signatures s so that the shingled run has greater spacing between the ends of successive signatures s.

This invention is intended to cover all changes and modifications of the example of the invention herein chosen for purposes of the disclosure which do not constitute departures from the spirit and scope of the invention.

What is claimed is:

1. A machine for arranging flexible sheets of generally equal size and shape in a stacked condition, said machine comprising: feed means for dropping the sheets one after the other in a generally horizontal orientation; first conveying belts located in part where the feed means drops the sheets so that the sheets tend to accumulate in a pile upon the belts with major surfaces of the sheets facing the belts, the belts moving away from the region at which the feed means deposits the sheets such as to withdraw the sheets from the bottom of the pile and convey them in an uninterrupted shingled manner away from the pile of sheets with the inclination of the sheets as they are conveyed away from the pile being no greater than about 45° with respect to the first belts; and deflecting surfaces located along the sides of the first belts and beyond the location at which the pile of sheets is formed on the belts, so that the belts lead up to and pass into the space between the deflecting surfaces, the deflecting surfaces extending generally upwardly with respect to the first belts to an elevation greater than that of the shingled sheets which approach the deflecting surfaces on the belts at an angle no greater than about 45°, the deflecting surfaces being at least in part oblique relative to each other, with the smallest distance between the deflecting surfaces being less than the width of the sheets, the deflecting surfaces being arranged and configured such that the sheets being conveyed toward and between the deflecting surfaces rise at their leading edges and simultaneously bow forwardly so as to thereafter stand on edge on the first belts and project away from the first belts as they pass between the deflecting surfaces; and means for maintaining the sheets in an edge-standing condition beyond the deflecting surfaces such that the shingled sheets, the bowed sheets between the deflecting surfaces and the edge-standing sheets form an uninterrupted array of sheets.

2. A machine according to claim 1 and further comprising second belts located beyond the first belts for receiving and conveying the sheets as they pass off of the first belts, with the second belts moving away from the first belts at a velocity less than that of the first belts, whereby the sheets which are turned on edge pass onto the second belts and are consolidated generally at the transition between the first and second belts.

3. A machine according to claim 2 and comprising third conveyor having a moving surface that is located immediately beyond the second belts, such that the sheets while standing on edge will pass from the second belts to the moving surface of the third conveyor; and wherein the moving surface of the third conveyor is capable of operating at a velocity greater than that of the second belts, so as to create a gap in the array of stacked sheets and thereby isolate some of the stacked sheets as a bundle.

4. A machine according to claim 3 and further comprising parallel confining surfaces along the second belts and third conveyor, the distance between confining surfaces being less than the width of the sheets so that the sheets remain bowed while along the moving second belts and third conveyor.

5. A machine according to claim 3 and further comprising means for removing the isolated bundle from the third conveyor.

6. A machine according to claim 5 wherein the means for removing the isolated bundle includes pusher means for pushing the isolated bundle off of the third conveyor.

7. A machine according to claim 6 and further comprising a fourth conveyor that is located beyond the third conveyor, and the pusher means pushes the isolated bundle onto the fourth conveyor.

8. A machine according to claim 5 and further comprising means over the second belts for preventing the leading sheet in the array of edge-standing sheets from toppling over as the sheets move along the second belts.

9. A machine according to claim 5 and further comprising means for placing rigidifying boards at ends of a bundle of sheets.

10. A machine according to claim 9 and further comprising compacting means for compressing the isolated bundle of sheets so that a tie may be placed around the isolated bundle while it is compressed.

11. A machine according to claim 1 wherein the feed means discharges the sheets onto the first belts from the side of the first belts so the direction of advance along the first belts is generally at a right angle to the direction along which the feed means discharges the sheets onto the first belts.

12. A machine according to claim 11 wherein the moving surface of first belts are inclined downwardly away from the region at which the feed means introduces the sheets onto the first belts.

13. A machine according to claim 12 wherein the feed means discharges the sheets transversely with respect to the direction of movement for the first belts, and further comprising a stop surface located on the opposite side of the first belts from the feed means, the stop surface being positioned such that the edges of the sheets will come to rest against it and come generally into registration.

14. A machine according to claim 13 wherein the feed means flutes the sheets as they are discharged over the moving first belts to impart some rigidity to the sheets.

15. A machine according to claim 14 and further comprising surfaces along the second belts for confining the sheets and maintaining them in a bowed condition.

16. A machine according to claim 14 wherein the feed means discharges the sheets laterally with respect to the direction of movement for the first belts so that each discharged sheet slides over a sheet that is already supported on the first belts with the sliding being transverse to the direction of movement for the first belts.

17. A machine according to claim 16 wherein the feed means comprises means for fluting the sheets in the direction that they are discharged from the feed means as they are discharged so as to impart greater rigidity to the sheets as they are discharged laterally over the first belts.

18. A machine according to claim 15 and further comprising additional belts located beyond the second belts so that the sheets which are on edge pass onto the additional belts, and means along the additional belts for separating some of the sheets to isolate a bundle of sheets.

19. A machine according to claim 18 and further comprising means in the region of the additional belts for placing boards at the ends of the bundle.

20. In combination with a multitude of flexible sheets of generally equal size and shape, a machine for arranging the sheets one after the other in a stacked condition, said machine comprising: an upwardly presented conveying surface that moves in a direction of advance from an upstream location to a downstream end; spaced apart deflecting surfaces located along sides of the conveying surface such that the conveying surface leads up to and passes into the space between the deflecting surfaces, the deflecting surfaces rising upwardly with respect to the conveying surface so as to be presented above and in a generally upright condition with respect to the conveying surface, the deflecting surfaces being at least in part oblique relative to each other, with the smallest distance between the deflecting surfaces being less than the width of the sheets; and a supporting surface located beyond and aligned with the downstream end of the conveying surface; the flexible sheets being arranged in succession along the conveying surface and the supporting surface in an uninterrupted array; means for feeding the sheets onto the conveying surface and means for moving the conveying surface away from the feeding means to form the sheets upstream from the deflecting surfaces in a shingled condition with leading edges of any one of the shingled sheets being generally over the sheet immediately ahead of it and at an elevation above the conveying surface that is less than the elevation to which the deflecting surfaces rise above the conveying surface, and with the trailing edges of the shingled sheets being at the conveying surface and with a major surface area on each sheet being presented primarily toward the conveying surface, wherein the sheets between the deflecting surfaces are bowed generally forwardly in the direction of advance and rise gradually from the shingled condition to an edge-standing condition on the conveying surface, and wherein the sheets along the supporting surface are in the edge-standing condition, the flexible sheets on the conveying surface further moving in the direction of advance for the conveying surface, so that the sheets are gradually transformed from the shingled condition to the edge-standing condition and are deposited on the supporting surface in generally an edge-standing condition with respect to that surface.

21. The combination of claim 20 wherein the supporting surface comprises a second conveying surface which moves away from the first conveying surface at a velocity less than the first conveying surface, whereby the edge-standing sheets tend to move closer together and consolidate on the second conveying surface.

22. The combination according to claim 21 and further comprising spaced apart side surfaces located along and projecting upwardly above the second conveying surface, with the space between the side surfaces being less than the width of the signatures, so that the edge-standing sheets remain bowed forwardly along the second conveying surface and do not fall.

23. The combination according to claim 20 and further comprising spaced apart side surfaces located along the sides of and projecting upwardly with respect to the supporting surface, with the space between the side surfaces being less than the width of the sheets, so that the edge-standing sheets are bowed forwardly along the supporting surface, and means for exerting a downwardly directed force at the upper edges of the forwardly bowed edge-standing sheets that are over the supporting surface, so that the edge-standing sheets are urged downwardly against the supporting surface.

24. The combination according to claim 23 wherein the supporting surface comprises a second conveying surface which moves at a velocity less than the first conveying surface, whereby the edge-standing sheets tend to move closer together and consolidate on the second conveying surface.

25. The combination according to claim 24 and further comprising accumulating means aligned with and located beyond the second conveying surface for supporting edge-standing sheets beyond the second conveying surface, the accumulating means causing the sheets to consolidate still further.

26. A machine for arranging highly flexible sheets in a stacked condition, said machine comprising: a conveying surface onto which the sheets are directed, means for feeding the sheets onto the conveying surface and means for moving the conveying surface away from the location at which the sheets are directed onto it to form the sheets in a shingled array on the conveying surface with the leading edge of any one sheet generally overlying the sheet immediately ahead of it and with the trailing edges of the sheets being against the conveying surface, all such that a major surface area on each sheet in the shingled array faces primarily toward the conveying surface; spaced apart deflecting surfaces located along and projecting upwardly with respect to the conveying surface such that the conveying surface leads up to and into the space between the deflecting surfaces, whereby the conveying surface carries the shingled sheets up to and into the space between the deflecting surfaces, the deflecting surfaces projecting upwardly above the conveying surface to an elevation that is with respect to the conveying surface higher than the leading edges of the sheets in the shingled array of sheets that approach the space between the deflecting surfaces, the deflecting surfaces being at least in part oblique relative to each other, with the smallest distance between the deflecting surfaces being less than the width of the sheets, the deflecting surfaces being arranged and configured such that they urge the side edges of the sheets which pass between them inwardly so as to cause the sheets to simultaneously bow forwardly and rise at their leading edges to assume an edge-standing condition in which they are positioned generally upright and loosely arranged on the conveying surface; spaced apart confining surfaces located along the conveying surface immediately beyond the deflecting surfaces with the space between the confining surfaces likewise being less than the width of the sheets, so that the sheets remain bowed forwardly and edge-standing as they are moved by the conveying surface away from the deflecting surfaces; and jogging means located above the conveying surface in the region of the confining surfaces for contacting the sheets at their upper edges and urging them downwardly toward the conveying surface, the velocity of the coveying surface in the region of the jogging means being such that the sheets are less than fully consolidated so that the sheets may slip relative to each other, thus enabling the jogging means to bring the upper edges of the sheets generally into registration.

27. A machine according to claim 26 wherein the conveying surface includes first and second successive conveying belts, with the second belt extending away from the first belt in the region of the deflecting surfaces and moving at a lesser velocity.

28. A machine according to claim 27 and further comprising accumulating means located beyond the second belt for moving the sheets away from the second belt at a lesser velocity than the second belt, whereby the sheets further consolidate on the accumulating means.

29. A machine according to claim 26 wherein the downstream ends of the deflecting surfaces are oblique to the conveying surface.

30. A process for arranging flexible sheets in a stacked condition, said process comprising: depositing the sheets on a moving conveying surface and moving the conveyor surface such that the sheets are formed and advanced in a shingled condition in which the leading edge of any one of the shingled sheets overlies the sheet immediately ahead of it and the trailing edge is at the conveying surface, the shingled sheets further having major surface areas which face primarily toward the conveying surface; moving the shingled sheets while on the conveying surface toward a space between spaced apart deflecting surfaces which project upwardly with respect to the conveying surface to an elevation that is with respect to the conveying surface greater than the elevation of the leading edges of the shingled sheets, the deflecting surfaces being at least in part oblique relative to each other, with the smallest distance between the deflecting surfaces being less than the width of the sheets; moving the shingled sheets while they are on the conveying surface through the space between the deflecting surfaces such that the sheets bow forwardly on the conveying surface and simultaneously rise at their leading edges, so that the sheets upon passing through the space between the deflecting surfaces assume an edge-standing condition on the conveying surface, whereby the sheets assume a generally stacked condition in which the succession sheets, by reason of the preceding shingled arrangement, is less than fully consolidated.

31. A process according to claim 30 wherein the sheets upon assuming the edge-standing condition remain bowed forwardly on the conveying surface, and further comprising jogging the sheets while they are edge-standing and bowed forwardly on the conveying surface and while they are in the less than fully consolidated condition.

32. The process according to claim 31 wherein the step of jogging the sheets comprises passing the edge-standing sheets on the conveying surface beneath a vibrating plate which rests on the upper surfaces of the edge-standing sheets while they are less than fully consolidated.

33. A process according to claim 30 wherein the velocity of the conveying surface leading up to and into the space between the deflecting surfaces is greater than the velocity of the conveying surface where the sheets are moved in an edge-standing condition, whereby the succession of sheets is consolidated somewhat as the sheets advance in the edge-standing condition.

34. A process according to claim 30 and further comprising confining the sheets at their edges after the sheets are elevated to their edge-standing condition, so that the sheets remain bowed forwardly as they are advanced at the lesser velocity.

35. The process according to claim 32 and further comprising segregating some of the sheets from the stacked edge-standing sheets to form a bundle of sheets, compressing the bundle of sheets, and placing a binding material around the bundle.

36. The process according to claim 33 and further comprising placing boards at the ends of the bundle before the binding material is placed around the bundle.

37. A process for arranging flexible sheets in a stacked condition, said process comprising: placing the sheets on a conveying surface that moves in one direction away from the location at which the sheets are so placed; moving the sheets on the surface in a shingled condition along a path with the leading edge of any sheet being spaced from the conveying surface and generally overlying the sheet immediately ahead of it in the direction of advance and with the trailing edges of the sheets being at the conveying surface, all such that a major surfaceon each sheet in the shingled array faces primarily toward the conveying surface, whereby a continuous array of sheets exists along the path; and at a selected location along the conveying surface, which location is downstream from the location at which the sheets are placed on the conveying surface, urging the sides of the moving sheets inwardly toward each other while the sheets are contemporaneously advanced on the conveying surface so as to cause the sheets at that location to bow forwardly in the direction of advance and to further cause the leading edges of the sheets to rise sufficiently that the sheets stand on edge along the path, the transition in the array of sheets from the shingled condition to the edge-standing condition being gradual and generally without interruption in the array of sheets, the edge-standing sheets by reason of having been derived from the array of shingled sheets being less than fully consolidated at the selected location; moving the edge-standing sheets on the conveying surface away from the selected location while such sheets are less than fully consolidated; and jogging the sheets while they are edge-standing in the less than fully consolidated condition so as to bring the upper margins of the edge-standing sheets generally into registration.

38. A process according to claim 37 wherein the step of jogging the edge-standing sheets comprises passing the edge-standing sheets while they are less than fully consolidated beneath a vibrating plate which rests on and is supported by the edge-standing sheets.

39. A process according to claim 37 wherein the step of urging the sides of the moving sheets inwardly comprises passing the moving sheets while they are on and advanced by the conveying surface between spaced apart deflecting surfaces which rise above the conveying surface a distance greater than the distance at which the leading edges of the sheets in the shingled array of sheets are located above the conveying surface, the smallest distance between the deflecting surfaces being less than the width of the sheets.

* * * * *

UNITED STATES PATENT AND TRADEMARK OFFICE

CERTIFICATE OF CORRECTION

PATENT NO. : 4,531,343

DATED : July 30, 1985

INVENTOR(S) : James R. Wood

It is certified that error appears in the above-identified patent and that said Letters Patent are hereby corrected as shown below:

Column 12, line 42, "boards C" should be "boards c".

Column 15, line 13, "typing" should be "tying".

Column 15, line 53, "needle" should be "needles".

Column 17, line 47, "sightly" should be "slightly".

Column 22, line 6, "to claim 14" should be "to claim 2".

Column 22, line 9, "to claim 14" should be "to claim 2".

UNITED STATES PATENT AND TRADEMARK OFFICE

CERTIFICATE OF CORRECTION

PATENT NO. : 4,531,343

DATED : July 30, 1985

INVENTOR(S) : James R. Wood

It is certified that error appears in the above-identified patent and that said Letters Patent are hereby corrected as shown below:

Column 25, line 22, "to claim 32" should be "to claim 30".

Column 25, line 27, "to claim 33" should be "to claim 35".

Column 25, line 40, "surfaceon" should be two separate words.

Signed and Sealed this

*Twenty-ninth* Day of *October 1985*

[SEAL]

*Attest:*

*Attesting Officer*

DONALD J. QUIGG

*Commissioner of Patents and Trademarks—Designate*